US005299719A

United States Patent [19]

Newgas

[11] Patent Number: 5,299,719

[45] Date of Patent: Apr. 5, 1994

[54] TASSELS AND THEIR PRODUCTION

[75] Inventor: John R. Newgas, London, England

[73] Assignee: Albion Manufacturing Co. Ltd., London, England

[21] Appl. No.: 823,885

[22] Filed: Jan. 22, 1992

[30] Foreign Application Priority Data

Jan. 25, 1991 [GB] United Kingdom ..... 9101647

[51] Int. Cl.[5] ..... D04D 7/08

[52] U.S. Cl. ..... 223/46; 28/147

[58] Field of Search ..... 28/147; 139/385; 223/46; 428/28

[56] References Cited

U.S. PATENT DOCUMENTS

| | | | |
|---|---|---|---|
| 1,701,514 | 2/1929 | Tashman | 28/147 X |
| 3,105,243 | 10/1963 | Kampfe et al. | 428/28 X |
| 3,395,738 | 8/1968 | Rhodes | 139/385 |
| 3,969,090 | 7/1976 | Sasena et al. | 15/198 X |
| 4,884,807 | 12/1989 | Welch | 428/95 X |

FOREIGN PATENT DOCUMENTS

| | | | |
|---|---|---|---|
| 264399 | 1/1927 | United Kingdom | 428/28 |
| 431751 | 7/1935 | United Kingdom | 428/28 |

*Primary Examiner*—Henry F. Epstein

*Attorney, Agent, or Firm*—Hopgood, Calimafde, Kalil, Blaustein & Judlowe

[57] ABSTRACT

A tassel is formed from a cord which comprises a plurality of twisted ply yarns or strands. A knot is tied in the cord to separate an end portion from a main length of the cord and the end portion is immersed in liquid to cause the yarns or filaments there to untwist and form a loose tuft. This process is advantageously carried out in hot liquid and by using a hot dye bath the dyeing of the tassel and the formation of its tuft are achieved simultaneously.

12 Claims, 1 Drawing Sheet

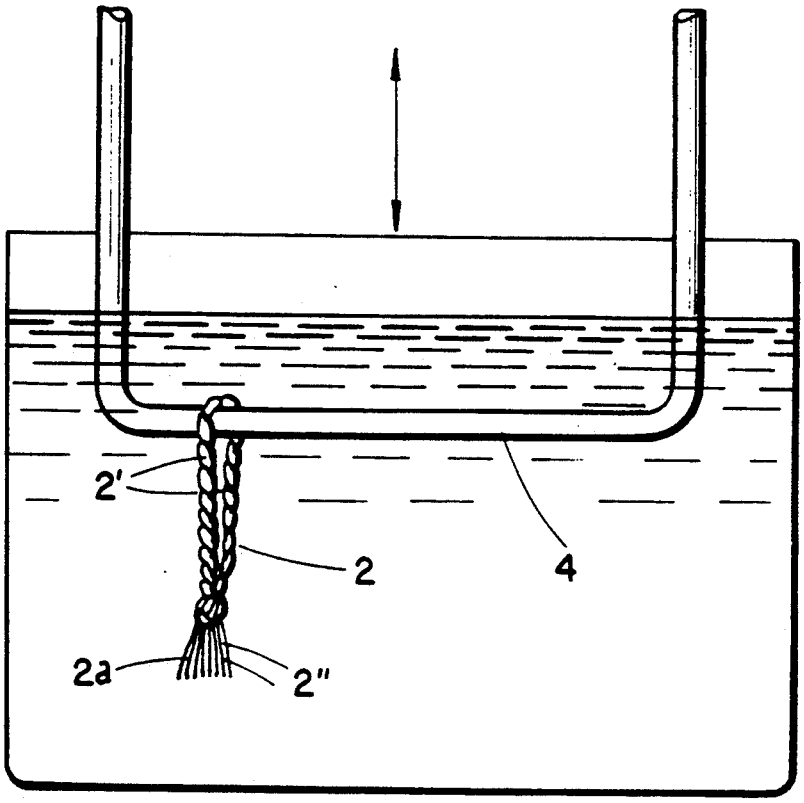
2'
2
4
2a
2"

TASSELS AND THEIR PRODUCTION

BACKGROUND OF THE INVENTION

This invention relates to tassels, such as are used with articles of stationery as an element of decoration, or for other decorative purposes, or for handles, ties etc.

Conventionally, a tassel comprises a suitably coloured cord to at least one end of which is knotted a decorative tuft of loose filaments or yarns, usually dyed to the same shade as the cord. In some examples, both ends of the cord are similarly treated, in others the two ends are worked into the knot so that the cord forms a loop knotted to the decorative tuft.

SUMMARY OF THE INVENTION

The present invention provides a method of producing a tassel in which a knot is formed in a cord comprising a plurality of strands twisted together, said knot separating an end portion from a main length of the cord, and said end portion is immersed in liquid so as to cause the filaments or yarns of said end portion to at least partially untwist and form a tuft of loose filaments or yarns. This method is preferably performed with agitation of the immersed cord and/or the surrounding liquid.

With suitable choice of materials the untwisting of the end portion can be accelerated by heat and it is preferably carried out at a temperature above ambient. It is particularly convenient to perform the method by immersing the articles in a hot dye bath so that the dyeing of the tassel is achieved simultaneously with the formation of the tuft.

It will be clear that the method of the present invention is able to form tassels much more simply and economically than the conventional method.

Analogously to conventional tassels having tufts of loose yarns knotted into each end of a cord, tassels produced in accordance with the method of the present invention can be made by knotting a length of cord near each end, to separate opposite end portions from the main length of the cord to form tufts in the same way at both ends. It is also possible to tie the cord in a loop with end portions protruding so that both end portions are tied together by the same knot and form a combined single tuft.

The invention also comprises a tassel formed from a cord comprising a plurality of strands twisted together and having a knot separating at least one end portion from a main length of the cord, said cord having been dyed after the formation of said knot and the filaments or yarns of said at least one end portion being at least partially untwisted to form a tuft of loose filaments or yarns.

BRIEF DESCRIPTION OF THE DRAWING

The drawing is a schematic illustration of a dye bath apparatus in which the method of the present invention can be performed.

DESCRIPTION OF THE PREFERRED EMBODIMENTS

In performing the method of the present invention, for ease of handling in the process, the material of the cord is preferably denser than water. A suitable example is the material commercially known as 660 decitex 90 filaments viscose rayon yarn which is a continuous filament material. The cord has two ply yarns or strands 2' each of which comprises 9 sub-strands or yarn lengths, each said yarn length being composed of a number of the continous filaments.

In the first stage of this process each ply yarn is formed with a twist imparted to the filaments in the clockwise direction and in a second stage the two ply yarns are twisted together in the opposite, anti-clockwise, direction. The amount of twist in the first stage is preferably greater than the amount of twist in the second stage, e.g. being about 1.8 to 2 times as much as in the second stage. The completed cord is cut into lengths each of which is doubled over and tied in a knot near its ends so as to form a loop, e.g. some 130–230 mm long depending on the intended purpose, with two shorter free end portions about 25–40 mm long extending in generally the same direction from the knot.

As illustrated in the accompanying drawing, the looped lengths 2 (only one of which is shown) are placed on a suitable carrier 4 and are lowered into a hot-water bath 6 to wet the material thoroughly. The temperature may typically be between 60° C. and 100° C., dependent primarily on the requirements of the dyestuff which if not present during the wetting stage is then added to the bath or is contained in a further bath (not shown) to which the cord lengths are transferred. After dyeing, the articles may be rinsed to remove surplus dye and then dried by conventional methods.

It is found that the end portions untwist almost immediately, once they are immersed, both as regards the ply yarns 2' and the individual filaments or yarns 2'' of each ply yarn. Agitation of the tassels in the bath both assists the dyeing process and promotes an even spread of the filaments or yarns of the tufts **2*a***. It is believed that the wetting of the cord, aided by the agitation causes the untwisting while the heat and agitation assist the dispersal of greases or other surface deposits remaining on the filaments or yarns from the manufacturing process so that they separate more easily from each other. It is also possible to add a detergent material to the bath to aid this latter effect.

A feature of the novel method is that the manner of formation of the tufts without handling them allows the individual elements of the tuft to spread out generally uniformly simply by the action of the liquid. This effect can be assisted by the agitation of the tassels and/or of the liquid in which they are immersed.

The process is generally suitable for all cords formed from yarns or filaments which do not have a tendency to felt or mat, but cords with two or more ply yarns will usually be preferred because the tuft can be made up of a greater number of filaments or yarns. Still more yarns can be included by making up the cord from multiple strands each composed of multiple ply yarns. In general, however, any multiple strand cord of suitable material can be used, whether the strands are themselves monofilaments or are formed from twisted yarns or filaments. The choice will be dependent upon the desired appearance of the end product.

The invention can be employed with a wide variety of artificial fibres, including regenerated cellulose (rayon), acrylic, polyamide and polyester fibres. These are all fibres that have little or no tendency to felt or mat, are wettable with water and are denser than water. Cords of these materials are also relatively easily dyed.

I claim:

1. A method of producing a tassel comprising the steps of forming a knot in a cord which comprises a plurality of strands twisted together, each said strand comprising yarns or filaments, an end portion of the cord and a main length of the cord being separated by said knot, and immersing at least said end portion in liquid so as to cause the yarns or filaments of said end portion to at least partially untwist and form a tuft of loose yarns or filaments.

2. A method according to claim 1 wherein relative agitation is generated between the immersed cord and the liquid while said end portion is immersed in the liquid.

3. A method according to claim 1 wherein the liquid is maintained at a temperature higher than ambient.

4. A method according to claim 3 wherein the liquid forms a hot dye bath and the tassel is subjected to a hot dyeing process while the strands of said end portion are untwisted.

5. A method according to claim 1 wherein the cord is knotted to form the main length in a loop and respective shorter end portions at opposite ends of the cord extend from the knot to provide said tuft.

6. A method according to claim 1 wherein the cord strands are each formed from a plurality of yarns or filaments, said yarns or filaments of each strand being twisted in a direction opposite to the twist of the strands.

7. A method according to claim 6 wherein the yarns or filaments are twisted to a greater degree than are the strands.

8. A method of producing a tassel from a cord of artificial fibres wherein the cord comprises a plurality of strands twisted together, and wherein each strand comprises yarns or filaments, said method comprising the steps of:

(a) forming a knot in the cord at a location short of an end of the cord so as to leave a free untied portion at said end, wherein the free untied portion is separated by said knot from the main length of the cord;

(b) immersing at least said end portion in a liquid so as to cause the yarns or filaments of said end portion to at least partially untwist and form a tuft of loose yarns or filaments; and (c) drying the yarns or filaments in their at least partially untwisted state.

9. The method of claim 8, wherein the cord is selected (a) for fibres having little or no tendency to felt or mat, (b) for being wettable in water, and (c) for fibres that are of density exceeding the density of water.

10. The method of claim 8, wherein the fibre material of the cord is selected from the group consisting of regenerated cellulose (rayon), acrylic, polyamide and polyester materials.

11. A method of producing a tassel from a cord of artificial fibres wherein the cord comprises a plurality of strands twisted together, and wherein each strand comprises yarns or filaments, said method comprising the steps of:

(a) forming a knot in the cord at a location short of an end of the cord so as to leave a free untied portion at said end, wherein the free untied portion is separated by said knot from the main length of the cord;

(b) partially untwisting the yarns or filaments of said end portion to form a tuft of loose yarns or filaments by at least immersing said end portion in a liquid; and (c) drying the yarns or filaments in their at least partially untwisted state.

12. A method of producing a tassel from a cord of artificial fibres wherein the cord comprises a plurality of strands twisted together, and wherein each strand comprises yarns or filaments, said method comprising the steps of:

(a) forming a knot in the cord at a location short of an end of the cord so as to leave a free untied portion at said end, wherein the free untied portion is separated by said knot from the main length of the cord;

(b) forming said end portion into a tuft of loose yarns or filaments by at least partially untwisting the yarns or filaments of said end portion;

(c) said forming step (b) including at least the immersion of at least said end portion in a liquid; and (d) drying the yarns or filaments in their at least partially untwisted state.

* * * * *